United States Patent [19]

Yamazaki et al.

[11] Patent Number: 4,736,183

[45] Date of Patent: Apr. 5, 1988

[54] OXIDE RESISTOR

[75] Inventors: Takeo Yamazaki; Satoru Ogihara, both of Hitachi; Tetsuo Kosugi, Naka; Shingo Shirakawa, Hitachi; Shinichi Owada, Katsuta, all of Japan

[73] Assignee: Hitachi, Ltd., Tokyo, Japan

[21] Appl. No.: 748,166

[22] Filed: Jun. 24, 1985

[30] Foreign Application Priority Data

Jun. 22, 1984 [JP] Japan ..... 59-127474
May 10, 1985 [JP] Japan ..... 60-97805

[51] Int. Cl.[4] ..... H01C 7/10; H01H 35/16

[52] U.S. Cl. ..... 338/20; 338/21; 338/308; 338/330; 200/144 AP; 200/148 A; 252/518; 252/519; 252/520

[58] Field of Search ..... 338/308, 309, 21, 20, 338/330; 200/144 AP, 148 B; 252/518, 519, 520

[56] References Cited

U.S. PATENT DOCUMENTS 4,386,021 5/1983 Kazuo et al. ..... 338/21 X
4,439,651 3/1984 Thuries et al. ..... 200/144 AP

*Primary Examiner*—E. A. Goldberg
*Assistant Examiner*—Linda M. Peco
*Attorney, Agent, or Firm*—Antonelli, Terry & Wands

[57] ABSTRACT

A composite sintered oxide resistor comprising crystal grains of zinc oxide and crystal grains of a zinc oxide compound of other metal or semi-metal element than zinc, and a grain boundary layer having an electric resistance equal to or lower than that of the crystal grains and which of zinc oxide between the individual crystal grains has a very large withstanding capacity against switch surge, a small non-linear coefficient of voltage in the voltage-current characteristics, a positive, smaller resistance-temperature coefficient, and a small percent change in resistivity after heat treatment at 500° C. in the atmosphere.

32 Claims, 5 Drawing Sheets

OXIDE RESISTOR

BACKGROUND OF THE INVENTION

This invention relates to an oxide resistor, and particularly to an oxide resistor suitable for absorption of switching surge of a circuit breaker, etc.

As to so far known linear resistors for the circuit breaker, there have been proposed aluminum oxide-clay-carbon-based compositions having such characteristics as a withstanding capacity against the breaker switching surge of 200 Joules/cc, which will be hereinafter referred to as "J/cc", a resistance-temperature coefficient of $-9\times10^{-2}$ Ω/°C. (20°-250° C.) and an application temperature of 200° C. with a resistivity of about 400 Ω-cm.

With recent higher transmission voltage, a linear resistor of smaller size and lighter weight has been desired for the circuit breaker, and thus it has been required that (1) the resistor has a larger withstanding capacity aginst the switching surge, (2) the resistor has a less fluctuation in resistivity, even if exposed to a high temperature, since the temperature is elevated by exposure to breaker switching surges, and (3) the resistor must be made from materials having a smaller resistance-temperature coefficient. The conventional resistor is made from an aluminum oxide-clay-based material by adding carbon thereto, and by sintering the mixture in an inert gas atmosphere to control the resistivity through the carbon content, and thus has such disadvantages that (1) the density of sintered product is low and the withstanding capacity against the switching surge is small, (2) the carbon having control of the resistivity is oxidized when the resistor is exposed to a high temperature, resulting in a large fluctuation in the resistivity, and (3) the resistance-temperature coefficient is large.

It is known to use a zinc oxide-based resistor in the circuit breaker [Japanese Patent Application Kobai (Laid-open) No. 55-57219], where the said requirements (1) to (3), particularly the increase in the withstanding capacity against the switching surge, have not been investigated.

As a result of extensive studies of crystal grains in sintered products that form resistors, the present inventors have successfully satisfied the said requirements.

SUMMARY OF THE INVENTION

An object of the present invention is to provide an oxide resistor having such characteristics as a resistivity of 40 to 1,000 Ω-cm, a large withstanding capacity against the breaker switching surge, no fluctuation in the resistivity even if exposed to a temperature of 500° C. or higher, and a low resistance-temperature coefficient.

Another object of the present invention is to provide an oxide resistor havig a resistance-temperature coefficient ranging from $-1\times10^{-3}$ Ω/°C. to $+4\times10^{-3}$ Ω/°C.

The present oxide resistor is a composite oxide sintered product comprising crystal grains of zinc oxide and crystal grains of zinc oxide compound of other metal or semi-metal element than zinc, and having no grain boundary layer of higher electric resistance than that of the crystal grains of zinc oxide between the individual crystal grains. Furthermore, the present oxide resistor is a composite sintered product comprising crystal grains of zinc oxide and crystal grains having an electric resistance of 200 Ω to $3\times10^{13}$ Ω, and having no grain boundary layer of higher electric resistance than that of the crystal grains of zinc oxide, the sintered product being in a plate form including a disc form and having electrodes at both end surfaces.

Among the individual crystal grains, there may be a grain boundary layer having an electric resistance equal to that of the crystal grains of zinc oxide, and there may be voids at positions corresponding to those of the grain boundary layers among the crystal grains. The voids include a complete absence of the grain boundary layers.

It is desirable that the crystal grains of zinc oxide compound have a resistance of 200 Ω to $3\times10^{13}$ Ω, which is higher than that of zinc oxide. It is also desirable that the zinc oxide compound is selected from compounds having the following chemical formulae: $Zn_2TiO_2$, $Zn_2SiO_4$, $Zn_2Sb_2O_{12}$, $Zn_2ZrO_4$, and $Zn_2SnO_4$. The said metal and semi-metal for forming these compounds are titanium (Ti), silicon (Si), antimony (Sb), zirconium (Zr), and tin (Sn). It is not desirable to use bismuth (Bi), because a grain boundary layer having a higher resistance is liable to be formed from Bi.

The raw materials for the sintered product are zinc oxide (ZnO) as the major component and other metal or semi-metal oxides than ZnO as the minor components, such as titanium oxide ($TiO_2$), silicon oxide ($SiO_2$), antimony oxide ($Sb_2O_3$), zirconium oxide ($ZrO_2$) and tin oxide ($SnO_2$).

The structure of the present sintered product is characterized by mutual relationship between the crystal grains, and can be prepared by properly selecting the amounts of the components, pressure, temperature, time and increasing or decreasing rate of temperature in view of the raw materials to be used. The resulting resistors generally show a linearity, but in the case of non-linearity it is effective to break the high resistance parts, particularly grain boundary layer, by applying a high voltage thereto.

As a result of extensive studies of making the breaker resistors smaller in the size and lighter in weight, the present inventors have found that (1) the applicable resistor must have a resistivity of 40 to 4,000 Ω-cm, a withstanding capacity against the switching surge of 400 J/cc or more, a resistance-temperature coefficient in a range of $\pm1\times10^{-3}$ Ω/°C. (20° to 500° C.), and a fluctuation in resistivity of being within ±10% even after exposed to a temperature of 500° C. or higher, and (2) the withstanding capacity against the switching surge of the resistor depends on formation of many kinds of crystal grains having various resistivities in the resistor and the density of the resistor. Thus, the raw materials for the resistor may be readily sinterable and must form new crystal grains having different electric resistance through reaction of the raw materials themselves, and the resulting sintered product must have a high density. Thus, the present inventors have investigated characteristics of resistors comprising zinc oxide, titanium oxide, and magnesium oxide as the basic components, and further containing antimony oxide, silicon oxide, zirconium oxide, tin oxide, etc., and consequently have found that (1) the withstanding capacity against the switching surge is 800 J/cc which is considerably high, that is, about 4 times that of the conventional product, (2) the resistance temperature coefficient can be improved through a change from negative to positive by the content of magnesium oxide (MgO) in the basic components, zinc oxide (ZnO), titanium oxide ($TiO_2$), and magnesium oxide (MgO), and (3) the resistivity can be improved by adding antimony oxide ($Sb_2O_3$), silicon oxide ($SiO_2$), zirconium oxide ($ZrO_2$), tin oxide ($SnO_2$), etc. to the basic components, ZnO, $TiO_2$ and MgO.

Preferable basic composition for the present resistor comprises 65 to 94.8% by mole of ZnO, 5 to 20% by mole of $TiO_2$, and 0.2 to 15% by mole of MgO. Furthermore, 0.2 to 15% by weight of at least one of such oxides as $Sb_2O_3$ (0.05 to 5% by mole), $SiO_2$ (0.2 to 23% by mole) and $ZrO_2$ (0.1 to 11% by mole) may be added to the basic composition. When the content of $TiO_2$ is above or below the said composition range, the resistance-temperature coefficient goes beyond the range of $\pm 1\times 10^{-3}$ Ω/°C., and such a resistor is not suitable for the circuit breaker. However, the withstanding capacity against the switching surge can be considerably improved by the presence of $TiO_2$, because it seems that a crystal $Zn_2TiO_4$ can be formed by sintering of ZnO and $TiO_2$ in the raw materials, and this crystal has an electric resistance of about 200 to 500 Ω, which is a little higher than 10–50 Ω of the ZnO crystal, and contributes to an improvement of the density of sintered product. MgO can change the resistance-temperature coefficient from negative to positive, and at least the resistance-temperature coefficient goes beyond the range of $\pm 1\times 10^{-3}$ Ω/°C., when the content of MgO is above or below the said composition range as in the case of $TiO_2$. When the content of MgO is above the said composition range, the withstanding capacity against the switching surge will be less than 400 J/cc, and such a resistor is not suitable for the circuit breaker. When the additives $Sb_2O_3$, $SiO_2$, $ZrO_2$ and $SnO_2$ exceed said composition ranges, the resulting resistor has a resistivity higher than $4\times 10^3$ Ω.cm and a lower withstanding capacity against the switching surge, and is not suitable for the circuit breaker. A cause for these phenomena seems tht the additives $Sb_2O_3$, $SiO_2$, $ZrO_2$ and $SnO_2$ react mainly with the basic component ZnO to form crystal grains such as $Zn_7Sb_2O_{12}$, $Zn_2SiO_4$, $Zn_2ZrO_4$, and $Zn_2SnO_4$ having electric resistances of $1\times 10\Omega$ to $3\times 10^{13}$ Ω, which are higher than that of the crystal grains ZnO and $Zn_2TiO_4$ formed from the basic composition of ZnO-$TiO_2$-MgO, and the resulting resistors have an unbalanced distribution of crystal grains having different electric resistances.

Thus, a particularly preferable composition for the present resistor contains 0.2 to 15% by weight (0.05 to 5% by mole) of $Sb_2O_3$, 0.2 to 15% by weight (0.2 to 23% by mole) of $SiO_2$, 0.2 to 10% by weight (0.1 to 7% by mole) of $ZrO_2$ and 0.2 to 10% by weight (0.1 to 6% by mole) of $SnO_2$ on the basis of the said basic components.

The present invention provides an oxide resistor, which is a composite oxide sintered product comprising zinc oxide as the major component and other oxide than the zinc oxide as the minor component, characterized in that the sintered product has a resistance-temperature coefficient of within a range of $\pm 5\times 10^{-4}$ Ω/°C. to $-5\times 10^{-4}$ Ω/°C. at 20° to 500° C., a resistivity of 100 to 4,000 Ω-cm at 20° C., a withstanding capacity against the switching surge of 500 to 800 J/cc and a voltage non-linear coefficient of 1.0 to 1.3 at $3\times 10^{-3}$ to 80 A/cm$^2$.

Furthermore, the present invention provides an oxide resistor, which is a sintered product comprising zinc oxide as the major component, 1 to 20% by mole of magnesium oxide, and 0.1 to 20% by mole of at least one of aluminum oxide, gallium oxide, lanthanum oxide and indium oxide, characterized in that a resistance layer having a lower resistivity than that of zinc oxide is formed between the crystal grains of zinc oxide. Particularly preferable are a sintered product comprising 70 to 92% by mole of zinc oxide, 3 to 10% by mole of magnesium oxide, and 5 to 15% by mole of aluminum oxide, and a sintered product comprising 68 to 90% by mole of zinc oxide, 3 to 10% by mole of magnesium oxide, 5 to 15% by mole of aluminum oxide, and 1 to 2% by mole of silicon oxide.

The present oxide resistor is a composite sintered product of crystal grains of zinc oxide and crystal grains having an electric resistance of 100 Ω to $4\times 10^{13}$ Ω, and having a grain boundary layer having a lower electric resistance than that of the crystal grains of zinc oxide between the crystal grains of zinc oxide. The sintered product may be in a plate form, a column form or a cylindrical form, and has electrodes on both end surfaces. The electrodes in a metal film are formed on substantially entire surfaces by melt injection of a metal such as Al, while leaving some bare end portion on the end surfaces.

Between the individual crystal grains, there may be a grain boundary layer having an electric resistance equal to that of the crystal grains of zinc oxide. It is desirable that the crystal grains of zinc oxide compound and other oxides than zinc oxide have an electric resistance of 100 Ω to $4\times 10^{13}$ Ω, which is higher than that of zinc oxide. The zinc oxide compound and other oxides than zinc oxide have the following chemical formulae. That is, to much improve the linearity of voltage-current characteristics, at least one of $ZnY_2O_4$, $ZnGa_2O_4$, $ZnLA_2O_4$, $ZnAl_2O_4$, $ZnIn_2O_3$, $MgAl_2O_4$, $MgY_2O_4$, $MgGa_2O_4$, $MgLa_2O_4$, $MgIn_2O_4$, $Al_2O_3$, $Y_2O_3$, $Ga_2O_3$, $La_2O_3$ and $In_2O_3$ is added to the bais component MgO. To form these compounds, metal or semi-metal elememts such as aluminum (Al), yttrium (Y), gallium (Ga), lanthanum (La), indium (In), etc. are added to the main components ZnO and MgO. It is not preferable to use Bi, because a layer of higher electric resistance is liable to be formed in the crystal grain boundary phase.

The raw materials for the present sintered product are zinc oxide (ZnO) and magnesium oxide (MgO) as the basic components, and the minor component is selected from oxides of trivalent metals and semi-metals other than ZnO and MgO, i.e. aluminum oxide ($Al_2O_3$), yttrium oxide ($Y_2O_3$), gallium oxide ($Ga_2O_3$), lanthanum oxide ($La_2O_3$) and indium oxide ($In_2O_3$). That is, the present inventors have investigated characteristics of resistors comprising zinc oxide and magnesium oxide as basic components and further containing aluminum oxide, yttrium oxide, gallium oxide, lanthanum oxide, indium oxide, etc. to improve the linearity of voltage-current characteristics of the resulting oxide resistors, and consequently have found that (1) the withstanding capacity against the switching surge can be considerably increased to 800 J/cc which is about 1.6 times that of the conventional resistor, (2) the resistance-temperature coefficient can be improved through a change from negative to positive by the content of magnesium oxide (MgO) in the basic components zinc oxide (ZnO) and magnesium oxide (MgO), and (3) the linearity of the resistivity and the voltage-current characteristics can be improved by adding aluminum oxide ($Al_2O_3$), yttrium oxide ($Y_2O_3$), gallium oxide ($Ga_2O_3$), lanthanum oxide ($La_2O_3$), indium oxide ($In_2O_3$), etc. to the basic components ZnO and MgO.

Preferable basic composition for the present resistor comprises 70 to 99.7% by mole of zinc oxide, 0.1 to 10% by mole of magnesium oxide, and 0.1 to 20% by mole of at least one of oxides such as $Al_2O_3$, $Y_2O_3$, $Ga_2O_3$, $La_2O_3$ and $In_2O_3$. The resistance-temperature coefficient can be greatly changed from negative to positive by the content of MgO, and when the content of MgO is above or below the said composition range, the resistance-temperature coefficient goes beyond the range of $-1\times10^{-3}$ Ω/°C. to $+4\times10^{-3}$ Ω/°C. When the content of MgO exceeds the said composition range, the withstanding capacity against the switching surge will be less than 400 J/cc, and such a resistor is not suitable for the circuit breaker. When the minor components of $Al_2O_3$, $Y_2O_3$, $Ga_2O_3$, $La_2O_3$ and $In_2O_3$ exceed the said composition range, the resistivity will be higher than 400 Ω.cm, and the withstanding capacity against the switching surge will be lowered. Such a resistor is not suitable for the circuit breaker. However, the resistivity can be controlled and the linearity of the voltage-current characteristics can be improved by addition of $Al_2O_3$, $Y_2O_3$, $Ga_2O_3$, $La_2O_3$, and $In_2O_3$. A cause for these phenomena seems that (1) the minor components of $Al_2O_3$, $Ga_2O_3$, $In_2O_3$ and $La_2O_3$ react mainly with the basic component ZnO or MgO to form crystal grains of $ZnAl_2O_4$, $ZnY_2O_4$, $ZnGaO_4$, $ZnLa_2O_4$, $ZnIn_2O_4$, $MgAl_2O_4$, $MgY_2O_4$, $MgGa_2O_4$, $MgLa_2O_4$ and $MgIn_2O_4$, whose electric resistances range from 50 .Ω to $4\times10^{13}$ Ω, which are higher than those of crystal grains of ZnO and MgO formed from the basic composition of ZnO-MgO, and (2) Al, Y, Ga, La and In are diffused into the crystal grains of ZnO to increase the carrier concentration in the crystal grains of ZnO.

Particularly preferable composition for the present resistor comprises 75 to 92.7% by mole of ZnO, 0.1 to 10% by mole of MgO, and at least one of 0.2 to 20% by mole of $Al_2O_3$, 0.2 to 10% by mole of $Ga_2O_3$, 0.02 to 5% by mole of $In_2O_3$ and 0.1 to 10% by mole of $La_2O_3$.

The present sintered resistor product is prepared, for example, by thoroughly mixing the said raw material oxide powders, adding water and a suitable binder such as polyvinyl alcohol to the mixture, pelletizing the resulting mixture, molding the pellets in a mold, and sintering the resulting molding by firing in the atmosphere in an electric furnace at a temperature of 1,200° to 1,600° C. The sintered product is polished at both end surfaces for forming electrodes, and the electrodes are formed on the polished end surfaces by plasma melt injection or baking. To prevent any electric discharge along the side surfaces of the resistor during the application, a ceramic layer or glass layer having a high resistivity may be provided on the side surfaces of the resistor. The thus prepared resistor generally has a linearity, but when it shows a non-linearity, it is effective to break the high resistance parts (particularly the grain boundary layer) by application of a high voltage thereto.

PREFERRED EMBODIMENTS OF THE INVENTION

EXAMPLE 1

3,460 g of ZnO, 398 g of $TiO_2$ and 102 g of MgO as basic components and 150 g of $Sb_2O_3$, 60 g of $SiO_2$, and 62 g of $ZrO_2$ as additives were exactly weighed out and wet mixed in a ball mill for 15 hours. The resulting powdery mixture was dried, and 5% by weight of an aqueous 5 wt. % polyvinyl alcohol solution was added thereto on the basis of the dried powdery mixture. The resulting mixture was pelletized. The pellets were molded into a disc of 35 mm in diameter and 20 mm thick in a mold under the molding pressure of 550 kg/cm$^2$. The molding was fired at 1,400° C. in the atmosphere for 3 hours at an increasing and decreasing temperature rate of 50° C./hr. Such crystal grains were formed in the resulting sintered product as ZnO crystal grains having an electric resistance of about 20 Ω, $Zn_2TiO_4$ crystal grains having an electric resistance of about 400 Ω, and $Zn_7Sb_2O_{12}$ crystal grains, $Zn_2SiO_4$ crystal grains and $Zn_2ZrO_4$ crystal grains hasving electric resistances of $1\times10^7$ to $3\times10^{13}$ Ω.

Separately, crystallized glass powders of low melting point (ASF-1400 glass of $ZnO$-$SiO_2$-$B_2O_3$ made by Asahi Glass K.K., Japan) were suspended in an ethylcellulose butylcarbitol solution, and the resulting suspension was applied to the side surface of the said sintered product to a thickness of 50 to 300 μm by a brush, and heated at 750° C. in the atmosphere for 30 minutes to bake the glass. The glass-coated sintered product was polished at both end surfaces thereof each to about 0.5 mm by a lapping machine and washed with trichloroethylene. The washed sintered product was provided with Al electrodes to make a resistor. The thus prepared resistor of the present invention was compared with the conventional resistor in the withstanding capacity against the switching surge, the resistance-temperature coefficient and the percent change in resistivity after heat treatment at 500° C. in the atmosphere. The results are given in Table 1.

TABLE 1

| | Characteristics | | | |
|---|---|---|---|---|
| | Resistivity (Ω · cm) | Withstanding capacity against switching surge (J/cc) | Resistance-temperature coefficient (Ω/°C.) (20°-500° C.) | Percent change in resistivity after heat treatment at 500° C. in the atmosphere (%) |
| Present invention | 500 | 810 | $+1\times10^{-5}$ | −2 |
| Conventional | 400 | 200 | $-9\times10^{-2}$ | +50 |

It is seen therefrom that the present resistor has a very large withstanding capacity against the switching surge, and smaller resistance-temperature coefficient and percent change in resistivity after heat treatment at 500° C. than those of the conventional resistor, and thus is much distinguished.

Figure 1:
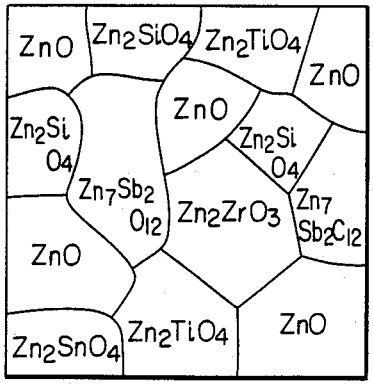
FIGS. 1 and 6 schematically show microstructures of oxide resistors according to embodiments of the present invention.
Figure 2:
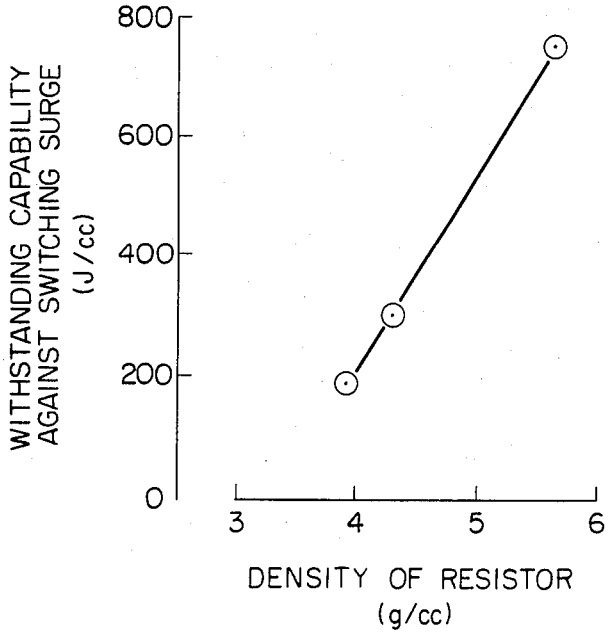
FIG. 2 is a characteristic diagram showing a relationship between the density of oxide resistor and the withstanding capacity against breaker switching surge.
Figure 3:
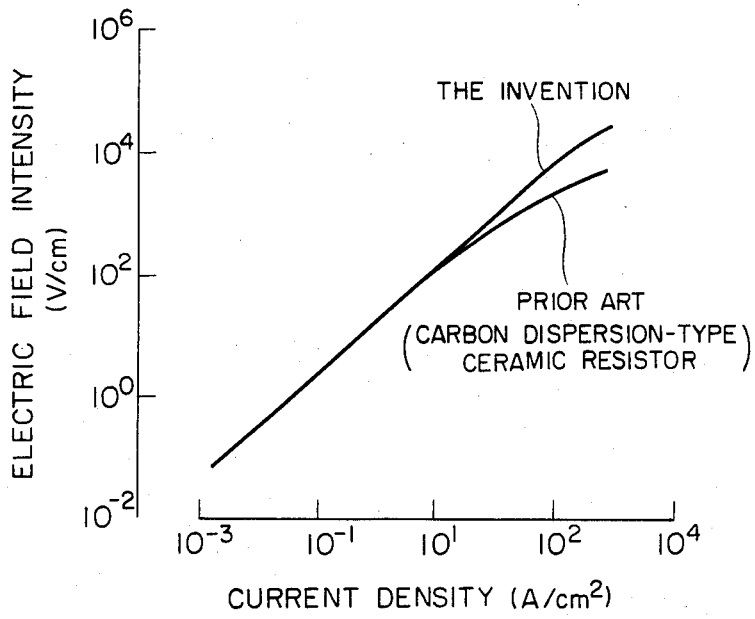
FIG. 3 is a diagram showing a relationship between the electric field intensity and the current density.

In FIG. 1, the microstructure of the present resistor thus prepared is shown; in FIG. 2 a relationship between the density ($g/cm^2$) of the thus prepared resistor and the withstanding capacity against the switching surge (J/cc) is shown; and in FIG. 3 the voltage-current characteristics of the thus prepared resistor are shown.

Electric resistance of the formed crystal grains was measured by mirror polishing the sintered product, analyzing the polished surface by a scanning type electron microscope, forming microelectrodes on the individual crystal grain surfaces, and measuring the current and voltage on the microelectrodes.

Figure 4:
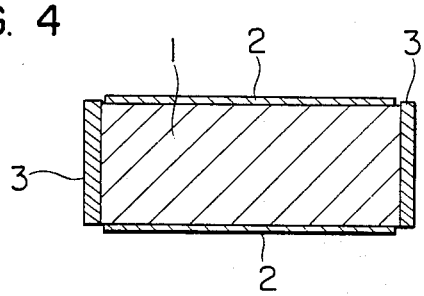
FIGS. 4 and 5 are cross-sectional view of an oxide resistor according to embodiments of the present invention.
Figure 5:
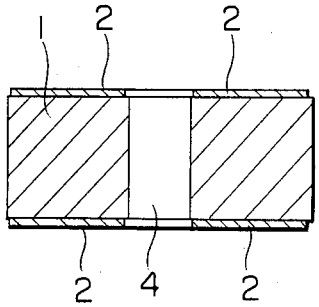

Embodiments of the present resistor structure are shown in FIGS. 4 and 5, where schematic cross-sectional views of the present resistor are shown, and numeral 1 is a sintered product, 2 electrodes, and 3 crystallized glass or ceramic film. As shown in FIG. 5, a hole 4 can be provided at the center of the present resistor. In the case of $SF_4$ gas-insulated neutral grounding, the electrodes are formed at inner positions other than the peripheral side surface.

EXAMPLE 2

To investigate changes in the characteristics by a mixing ratio of basic components, ZnO, $TiO_2$ and MgO, an amount x of $TiO_2$ and an amount y of MgO in the mixing formula (100-x-y) ZnO-x$TiO_2$-yMgO were changed each between 0.1 and 40% by moles, and their mixing amounts were exactly weighed out.

The weighed out raw material powders were mixed and fired at a temperature of 1,300° to 1,600° C. in the atmosphere for 4 hours in the same manner as in Example 1, and the densities of the resulting sintered products were 94 to 96% of the individual theoretical densities. The resulting sintered porducts were polished at both end surfaces each to about 0.5 mm by a lapping machine, ultrasonically washed in trichloroethylene. The washed sintered products were provided with Al electrodes by Al melt injection to make resistors. The resistivity, the withstanding capacity against the switching surge and the resistance-temperature coefficient of the thus prepared resistors are shown in Table 2.

TABLE 2

| Composition No. | Basic component ZnO (mol. %) | $TiO_2$ x (mol. %) | MgO y (mol. %) | Characteristics: Resistivity (Ω · cm) | Withstanding capacity against switching surge (J/cc) | Resistance temperature coefficient (Ω/°C.) (20°-500° C.) |
|---|---|---|---|---|---|---|
| 1 | 98.5 | 0.5 | 1 | $3.8 \times 10$ | 150 | $-8 \times 10^{-2}$ |
| 2 | 98 | 1 | 1 | $4 \times 10$ | 300 | — |
| 3 | 94 | 5 | 1 | $5 \times 10$ | 520 | $-7 \times 10^{-4}$ |
| 4 | 89 | 10 | 1 | $8 \times 10$ | 750 | $-8 \times 10^{-4}$ |
| 5 | 79 | 20 | 1 | $8.2 \times 10$ | 410 | $-1 \times 10^{-3}$ |
| 6 | 59 | 40 | 1 | $1.2 \times 10^2$ | 180 | $-6 \times 10^{-1}$ |
| 7 | 89.8 | 10 | 0.2 | $6.9 \times 10$ | 730 | $-1 \times 10^{-3}$ |
| 8 | 89.5 | 10 | 0.5 | $7.1 \times 10$ | 710 | $-3 \times 10^{-4}$ |
| 9 | 89 | 10 | 1 | $8 \times 10$ | 750 | $-8 \times 10^{-4}$ |
| 10 | 88 | 10 | 2 | $8.5 \times 10$ | 700 | $-4 \times 10^{-5}$ |
| 11 | 85 | 10 | 5 | $9 \times 10$ | 650 | $-1 \times 10^{-6}$ |
| 12 | 80 | 10 | 10 | $9.4 \times 10^2$ | 520 | $+1 \times 10^{-5}$ |
| 13 | 75 | 10 | 15 | $1.2 \times 10^2$ | 420 | $+8 \times 10^{-4}$ |
| 14 | 70 | 10 | 20 | — | 200 | $+5 \times 10^{-3}$ |
| 15 | 60 | 10 | 30 | $9 \times 10^2$ | 110 | $+2 \times 10^{-2}$ |

It is seen from Table 2 that the resistors of composition Nos. 3 to 5 and 7 and 13, that is, the compositions containing ZnO and 5 to 20% by mole of $TiO_2$ and the compositions containing 75 to 89.8% by mole of ZnO and 10% by mole of $TiO_2$, where 0.1 to 15% by mole of MgO is further contained, have distinguished characteristics such as a resistivity of 40 to 120 Ω.cm, a withstanding capacity against the switching surge of 400 to 750 J/cc, and a resistance-temperature coefficient within a range of $-1\times10^{-3}$ to $+1\times10^{-3}$ Ω/°C., and thus are suitable for the circuit breaker.

Furthermore, it is seen from Table 2 that the withstanding capacity against the switching surge can be remarkably improved by adding $TiO_2$ to ZnO as the basic components. However, if the content of $TiO_2$ is too large, e.g. 40% by mole (Composition No. 6), the withstanding capacity is 180 J/cc, which is smaller than 200 J/cc of the conventional resistor. It is also seen therefrom that with increasing content of MgO, the resistance-temperature coefficient changes from negative to positive and it can be made to fall within the range of $\pm1\times10^{-3}$ Ω/°C. by selecting the optimum amount of MgO. Furthermore, it is seen therefrom that, even if the contents of $TiO_2$ and MgO are increased, the resistivity is kept in a range of about $4\times10$ to about $1.2\times10^2$ Ω.cm and undergoes no remarkable change. Thus, it is seen that a particularly preferable compositon of basic components for a resistor for the circuit breaker comprises 5 to 20% by mole of $TiO_2$ and 0.2 to 15% by mole of MgO, the balance being ZnO.

EXAMPLE 3

ZnO was exactly weighed out from the range of 83 to 90% by mole, $TiO_2$ from the range of 5 to 10% by mole, and MgO from the range of 5 to 7% by mole as basic components, while one of $Sb_2O_3$, $SiO_3$, $ZrO_2$ and $SnO_2$ was exactly weighed out each from the range of 0.2 to 30% by weight as an additive thereto, and the basic components and the additive were mixed and kept at a temperature of 1,200° to 1,600° C. in the atmosphere for 4 hours in the same manner as in Example 2 to make resistors. The resistivity, the withstanding capacity against the switching surge, and the resistance-temperature coefficient are shown in Table 3.

TABLE 3

| composition No. | Composition: Basic component ZnO (mol %) | TiO2 (mol %) | MgO (mol %) | Additive Sb2O3 (wt %) | SiO2 (wt %) | ZrO2 (wt %) | SnO2 (wt %) | Characteristics: Resistivity (Ω cm) | Withstanding capacity against switching surge (J/cc) | Resistance temperature coefficience (Ω/°C.) (20°-500° C.) |
|---|---|---|---|---|---|---|---|---|---|---|
| 1 | 83 | 10 | 7 | 0.2 | | | | $1 \times 10^2$ | 730 | $+2 \times 10^{-5}$ |
| 2 | 83 | 10 | 7 | 1 | | | | $8 \times 10^2$ | 770 | $+3 \times 10^{-7}$ |
| 3 | 90 | 5 | 5 | 5 | | | | $1.5 \times 10^3$ | 810 | $-2 \times 10^{-5}$ |
| 4 | 90 | 5 | 5 | 10 | | | | $2.4 \times 10^3$ | 680 | $-1 \times 10^{-4}$ |
| 5 | 90 | 5 | 5 | 15 | | | | $4 \times 10^3$ | 420 | $-1 \times 10^{-3}$ |
| 6 | 90 | 5 | 5 | 30 | | | | $8 \times 10^3$ | 170 | $-2 \times 10^{-2}$ |
| 7 | 88 | 5 | 7 | | 0.2 | | | $9 \times 10$ | 700 | $+1.5 \times 10^{-5}$ |
| 8 | 88 | 5 | 7 | | 1 | | | $4 \times 10^2$ | 800 | $+2 \times 10^{-6}$ |
| 9 | 88 | 5 | 7 | | 5 | | | $1 \times 10^3$ | 760 | $+1 \times 10^{-7}$ |
| 10 | 85 | 10 | 5 | | 10 | | | $2 \times 10^3$ | 510 | — |
| 11 | 85 | 10 | 5 | | 15 | | | $3.5 \times 10^3$ | 300 | $-1 \times 10^{-3}$ |
| 12 | 85 | 10 | 5 | | 25 | | | $7 \times 10^3$ | 190 | $-2 \times 10^{-2}$ |
| 13 | 85 | 10 | 5 | | | 0.2 | | $9.2 \times 10$ | 720 | $+1 \times 10^{-5}$ |
| 14 | 85 | 10 | 5 | | | 1 | | $6 \times 10^2$ | 780 | $+8 \times 10^{-6}$ |
| 15 | 85 | 10 | 5 | | | 5 | | $1.5 \times 10^3$ | 690 | $+4 \times 10^{-6}$ |
| 16 | 85 | 10 | 5 | | | 10 | | $3.4 \times 10^3$ | 640 | $+1 \times 10^{-5}$ |
| 17 | 85 | 10 | 5 | | | 15 | | $5.2 \times 10^3$ | 460 | $+1 \times 10^{-3}$ |
| 18 | 85 | 10 | 5 | | | 20 | | $2 \times 10^4$ | 190 | — |
| 19 | 88 | 5 | 7 | | | | 0.2 | $1.2 \times 10^2$ | 700 | $+1.7 \times 10^{-5}$ |
| 20 | 88 | 5 | 7 | | | | 1 | $1 \times 10^3$ | 760 | $+2 \times 10^{-6}$ |
| 21 | 88 | 5 | 7 | | | | 5 | $2.5 \times 10^3$ | 620 | $-1 \times 10^{-4}$ |
| 22 | 85 | 10 | 5 | | | | 10 | $4 \times 10^3$ | 400 | $-9 \times 10^{-4}$ |
| 23 | 85 | 10 | 5 | | | | 15 | $6 \times 10^3$ | 120 | $-2 \times 10^{-3}$ |
| 24 | 85 | 10 | 5 | | | | 30 | $1 \times 10^5$ | 70 | $-3 \times 10^{-2}$ |

It is seen from Table 3 that the resistors containing 0.2 to 30% by weight of $Sb_2O_3$, 0.2 to 25% by weight of $SiO_2$, 0.2 to 30% by weight of $ZrO_2$ or 0.2 to 30% by weight of $SnO_2$, that is, compositions Nos. 1 to 5, 7 to 10, 13 to 16, and 19 to 22, have distinguished characteristics, i.e. a resistivity of 90 to $4\times10^3$ Ω.cm, a withstanding capacity against the switching surge of 400 to 810 J/cc, and a resistance temperature coefficient within a range of $-1\times10^{-3}$ Ω/°C. to $+1\times10^{-3}$ Ω/°C., and are suitable for the circuit breaker.

It is also seen from Table 3 that the resistivity is increased with increasing contents of $Sb_2O_3$, $SiO_2$, $ZrO_2$ and $SnO_2$ as the additive, but the resistivity exceeds $4\times10^3$ Ω.cm and becomes unsuitable for the circuit breaker resistor, when the content of $Sb_2O_3$ exceeds 30% by weight (Composition No. 6), the content of $SiO_2$ exceeds 25% by weight (Composition No. 12), the content of $ZrO_2$ exceeds 15% by weight (Composition Nos. 17 and 18), and the content of $SnO_2$ exceeds 15% by weight (Composition Nos. 23 and 24). When the contents of $Sb_2O_3$, $SiO_2$, $ZrO_2$ and $SnO_2$ are too high as the additive, the withstanding capacity against the switching surge is lowered. For example, when the content of $Sb_2O_3$ exceeds 30% by weight (Composition No. 6), the content of $SiO_2$ exceeds 25% by weight (Composition No. 12), the content of $ZrO_2$ exceeds 30% by weight (Composition No. 18), and the content of $SnO_2$ exceeds 15% by weight (Compositions Nos. 23 and 24), the withstanding capacity is lowered to 70 to 190 J/cc, which is less than 200 J/cc of the conventional resistor.

The resistance-temperature coefficient tends to change from positive to negative with increasing contents of $Sb_2O_3$, $SiO_2$, $ZrO_2$ and $SnO_2$ as the additive. For example, when the content of $Sb_2O_3$ exceeds 30% by weight (Composition No. 6), the content of $SiO_2$ exceeds 25% by weight (Composition No. 12), the content of $ZrO_2$ exceeds 20% by weight (Composition No. 18), and the content of $SnO_2$ exceeds 15% by weight (Composition Nos. 23 and 24), the resistance-temperature coefficient will be less than $-1\times10^{-3}$ Ω/°C., and thus such resistors are not suitable for the circuit breaker.

It is seen therefrom that the preferable contents of $Sb_2O_3$, $SiO_2$, $ZrO_2$ and $SnO_2$ in the basic composition of $ZnO$-$TiO_2$-$MgO$ as a resistor for the cirsuit breaker are 0.2 to 15% by weight of $Sb_2O_3$, 0.2 to 15% by weight of $SiO_2$, 0.2 to 10% by weight of $ZrO_2$, and 0.2 to 10% by weight of $SnO_2$.

EXAMPLE 4

3,420 g (84% by mole) of ZnO and 101 g (5% by mole) of MgO as the basic components, and 510 g (10% by mole) of $Al_2O_3$, 47 g (0.5% by mole) of $Ga_2O_3$, and 369 g (0.5% by mole) of $In_2O_3$ as the minor components were exactly weighed out, and wet mixed in a ball mill for 15 hours. Then, the powdery mixture was dried, and 5% by weight of an aqueous 5 wt.% polyvinyl alcohol solution was added thereto on the basis of the dried powdery mixture. Then, the mixture was pelletized, and the pellets were molded into a disc, 35 mm in diameter and 20 mm thick in a mold under the molding pressure of 450 kg/cm$^2$. The molding was sintered by firing at 1,350° C. in the atmosphere for 3 hours at the increasing and decreasing temperature rate of 70° C./hr.

Crystal grains formed in the sintered product comprise crystal grains of ZnO having an electric resistance of about 10 to about 50 Ω, crystal grains of $ZnAl_2O_3$ having an electric resistance of about 70 to 100 Ω, and crystal grains each of $ZnGa_2O_4$, $ZnLa_2O_4$, $ZnY_2O_4$, $ZnIn_2O_3$, $MgAl_2O_4$, $MgY_2O_4$, $MgGa_2O_4$, $MgLa_2O_4$, $MgIn_2O_3$, $Al_2O_3$, $Ga_2O_3$, $La_2O_3$ and $In_2O_3$ each having an electric resistance of about 700 to $4\times10^{13}$ Ω.

The resulting sintered product was coated with crystallized glass of low melting point at the side surface in the same manner as in Example 1, and Al electrodes were likewise formed on both end surfaces thereof by melt injection. The withstanding capacity for the switching surge, the resistance-temperature coefficient, the percent change in resistivity after heat treatment at 500° C. in the atmosphere, and non-linear coefficient $\alpha$ of voltage in the voltage-current characteristic between the present resistor and the conventional resistor (carbon-dispersion type ceramic resistor) are shown in Table 4.

TABLE 4

| | Characteristics | | | | |
|---|---|---|---|---|---|
| | Resistivity (Ω · cm) | Withstanding capacity against switching surge (J/cc) | Resistance-temperature coefficient (Ω/°C.) (20°–500° C.) | Non-linear coefficient of voltage $3 \times 10^{-3}$ A/cm$^2$ ~80 A/cm$^2$ | Percent change in resistivity after heat treatment at 500° C. in the atmosphere (%) |
| Present invention | 550 | 800 | $+1.1 \times 10^{-4}$ | 1.02 | −2 |
| Conventional* | 400 | 500 | $-9 \times 10^{-2}$ | 1.10 | +50 |

*Carbon dispersion type ceramic resistor

It is seen from Table 4 that the present resistor has a very large withstanding capacity against the switching surge and a small non-linear coefficient $\alpha$ of voltage, and thus is more distinguished than the conventional resistor.

The present resistor has a positive resistance-temperature coefficient, an AC withstanding capacity of at least 20 A at 100 μs and $\beta$ of 0.9 to 1.0 in the V-I characteristics.

The electric resistances of the individual crystal grains were measured in the same manner as in Example 1.

Figure 6:
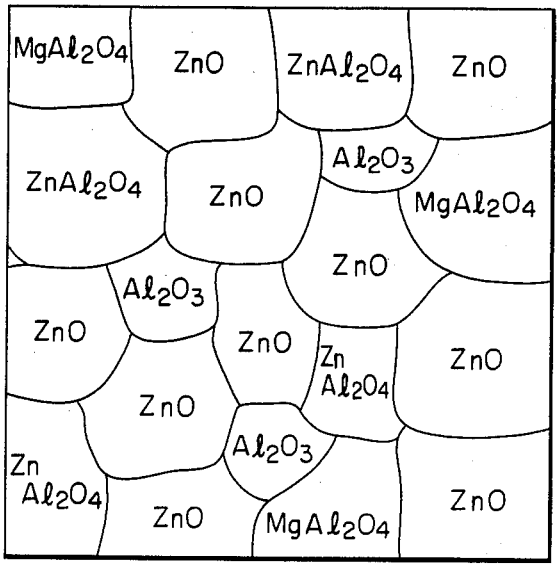

The schematic microstructure of the thus prepared oxide resistor of the present invention is shown in FIG. 6. Provision of crystallized glass film or ceramic material film on the side surface of the sintered product is made for preventing any electric discharge along the side surface during the application.

EXAMPLE 5

Basic component ZnO was exactly weighed out from the range of 65 to 99.95% by mole, basic component MgO from the range of 0.05 to 20% by mole, and at least one of minor components $Al_2O_3$, $Y_2O_3$, $La_2O_3$, $In_2O_3$, and $Ga_2O_3$ from the range of 0.1 to 30% by weight. The weighed out raw material powders were sintered by firing at a temperature of 1,300° to 1,600° C. in the atmosphere for 3 hours in the same manner as in Example 1. The densities of the resulting sintered products were 95 to 98% of the individual theoretical densities. The thus prepared sintered products were polished on both end surfaces each to about 0.5 mm with a lapping machine and ultrasonically washed in trichloroethylene. The washed sintered products were each provided with Al electrodes on both end surfaces by Al melt injection to make resistors. The resistivity, the withstanding capacity against the switching surge, the resistance-temperature coefficient, and the non-linear coefficient $\alpha$ of voltage of the thus prepared resistors are shown in Table 5.

TABLE 5

| | Composition | | | | | | | Characteristics | | | |
|---|---|---|---|---|---|---|---|---|---|---|---|
| | Basic component | | Minor component | | | | | | | | |
| Composition No. | ZnO (mol %) | MgO (mol %) | $Al_2O_3$ (wt %) | $Y_2O_3$ (wt %) | $La_2O_3$ (wt %) | $Ga_2O_3$ (wt %) | $In_2O_3$ (wt %) | Resistivity (Ω · cm) | Withstanding capacity against switching surge (J/cc) | Resistance-temperature coefficient (Ω/°C.) 20–500° C. | Non-linear coefficient of voltage $10^{-3}$ A/cm$^2$ −80 A/cm$^2$ |
| 1 | 99.95 | 0.05 | | | | | | $2 \times 10$ | 240 | $-4 \times 10^{-3}$ | 1.8 |
| 2 | 99.8 | 0.2 | | | | | | $6.5 \times 10$ | 395 | $-1 \times 10^{-3}$ | 1.8 |
| 3 | 99.5 | 0.5 | | | | | | $7 \times 10$ | 460 | $-3 \times 10^{-4}$ | 1.9 |
| 4 | 99 | 1 | | | | | | $8.2 \times 10$ | 620 | $+5 \times 10^{-5}$ | 1.6 |
| 5 | 95 | 5 | | | | | | $9 \times 10$ | 720 | $+6 \times 10^{-4}$ | 1.9 |
| 6 | 90 | 10 | | | | | | $1.2 \times 10^2$ | 490 | $+1.4 \times 10^{-3}$ | 2.0 |
| 7 | 80 | 20 | | | | | | $5 \times 10^2$ | 300 | $+4 \times 10^{-3}$ | 1.6 |
| 8 | 90 | 10 | 0.5 | | | | | $9.1 \times 10$ | 570 | $+1.1 \times 10^{-3}$ | 1.8 |
| 9 | 90 | 10 | 1 | | | | | $2.4 \times 10^2$ | 700 | $+1 \times 10^{-3}$ | 1.5 |
| 10 | 90 | 10 | 5 | | | | | $4 \times 10^2$ | 780 | $+4.3 \times 10^{-4}$ | 1.1 |
| 11 | 95 | 5 | 10 | | | | | $8 \times 10^2$ | 610 | $+8 \times 10^{-5}$ | 1.02 |
| 12 | 95 | 5 | 15 | | | | | $1.5 \times 10^3$ | 520 | $+2 \times 10^{-6}$ | 1.03 |
| 13 | 95 | 5 | 20 | | | | | $4 \times 10^3$ | 380 | $+1 \times 10^{-4}$ | 1.1 |
| 14 | 95 | 5 | 30 | | | | | $1 \times 10^5$ | 150 | $-1 \times 10^{-3}$ | 1.2 |
| 15 | 93 | 7 | | 0.2 | | | | $9.5 \times 10$ | 690 | $+3 \times 10^{-4}$ | 1.7 |
| 16 | 93 | 7 | | 0.5 | | | | $1.5 \times 10^2$ | 540 | $+8 \times 10^{-7}$ | 1.06 |
| 17 | 93 | 7 | | 1 | | | | $5 \times 10^2$ | 610 | $-2 \times 10^{-5}$ | 1.03 |
| 18 | 93 | 7 | | 5 | | | | $3.5 \times 10^3$ | 520 | $-5 \times 10^{-5}$ | 1.15 |
| 19 | 93 | 7 | | 10 | | | | $2 \times 10^6$ | 300 | $-4 \times 10^{-4}$ | 2.1 |
| 20 | 90 | 10 | | | 0.1 | | | $1.4 \times 10^2$ | 540 | $+1.5 \times 10^{-5}$ | 1.4 |
| 21 | 90 | 10 | | | 0.3 | | | $4 \times 10^2$ | 620 | $+7 \times 10^{-5}$ | 1.1 |
| 22 | 90 | 10 | | | 0.5 | | | $6 \times 10^2$ | 560 | $-2 \times 10^{-6}$ | 1.02 |
| 23 | 93 | 7 | | | 1 | | | $1 \times 10^3$ | 500 | $+3 \times 10^{-5}$ | 1.08 |
| 24 | 93 | 7 | | | 5 | | | $3.5 \times 10^3$ | 430 | $-8 \times 10^{-4}$ | 1.2 |
| 25 | 93 | 7 | | | 10 | | | $8 \times 10^5$ | 210 | $-4 \times 10^{-3}$ | 1.8 |

TABLE 5-continued

| Composition | | | | | | | | Characteristics | | | |
|---|---|---|---|---|---|---|---|---|---|---|---|
| Composition No. | Basic component ZnO (mol %) | Basic component MgO (mol %) | Minor component $Al_2O_3$ (wt %) | Minor component $Y_2O_3$ (wt %) | Minor component $La_2O_3$ (wt %) | Minor component $Ga_2O_3$ (wt %) | Minor component $In_2O_3$ (wt %) | Resistivity (Ω · cm) | Withstanding capacity against switching surge (J/cc) | Resistance-temperature coefficient (Ω/°C.) 20-500° C. | Non-linear coefficient of voltage $10^{-3}$ A/cm$^2$ −80 A/cm$^2$ |
| 26 | 90 | 10 | | | | 0.2 | | $1.5 \times 10^2$ | 550 | $+2 \times 10^{-4}$ | 1.7 |
| 27 | 90 | 10 | | | | 0.5 | | $5 \times 10^2$ | 600 | $+1.8 \times 10^{-5}$ | 1.08 |
| 28 | 90 | 10 | | | | 1 | | $9 \times 10^2$ | 540 | $-4 \times 10^{-6}$ | 1.1 |
| 29 | 85 | 15 | | | | 5 | | $1.8 \times 10^3$ | 500 | $+5 \times 10^{-6}$ | 1.12 |
| 30 | 85 | 15 | | | | 10 | | $4 \times 10^4$ | 420 | $-3 \times 10^{-4}$ | 1.2 |
| 31 | 85 | 15 | | | | 20 | | $5 \times 10^7$ | 260 | $-5 \times 10^{-3}$ | 1.4 |
| 32 | 93 | 7 | | | | | 0.1 | $1.1 \times 10^2$ | 530 | $+1 \times 10^{-5}$ | 1.3 |
| 33 | 93 | 7 | | | | | 0.3 | $6 \times 10$ | 600 | $+4 \times 10^{-6}$ | 1.15 |
| 34 | 93 | 7 | | | | | 0.5 | $1 \times 10^2$ | 580 | $+8 \times 10^{-5}$ | 1.02 |
| 35 | 85 | 15 | | | | | 1 | $1.5 \times 10^2$ | 540 | $-3 \times 10^{-6}$ | 1.09 |
| 36 | 85 | 15 | | | | | 5 | $5 \times 10^2$ | 530 | $-5 \times 10^{-4}$ | 1.1 |
| 37 | 85 | 15 | | | | | 10 | $3 \times 10^3$ | 320 | $-1 \times 10^{-5}$ | 1.16 |
| 38 | 85 | 15 | | | | | 20 | $1 \times 10^5$ | 140 | $-3 \times 10^{-3}$ | 1.3 |

It is seen from Table 5 that composition Nos. 10 to 12, 16 to 18, 21 to 23, 27 to 29, and 32 to 26, that is, the resistors comprising 80 to 92.9% by mole of ZnO and 5 to 1 5% by mole of MgO as the basic components and one of 5 to 15% by weight of $Al_2O_3$, 0.5 to 5% by weight of $Y_2O_3$, 0.3 to 1% by weight of $La_2O_3$, 0.5 to 5% by weight of $Ga_2O_3$ and 0.1 to 5% by weight of $In_2O_3$ as the minor components have such characteristics as a resistivity of 110 to 3,500 Ωcm, a withstanding capacity against the switching surge of 500 to 780 J/cc, a resistance-temperature coefficient within a range of $-5\times10^{-4}$ Ω/°C. to $+4.3\times10^{-4}$ Ω/°C., and a non-linear coefficient $\alpha$ of voltage of 1.02 to 1.3, and thus are distinguished as the resistors for the circuit breaker.

Furthermore, it is seen from Table 5 that the withstanding capacity against the switching surge can be improved by adding MgO to ZnO. However, when the content of MgO is 20% by mole (Composition No. 7), the withstanding capacity is 300 J/cc, which is smaller than 500 J/cc of the conventional resistor. By changing the content of MgO, the resistance-temperature coefficient changes from negative to positive, and can be made to fall, for example, within a range of $-1\times10^{-3}$ Ω/°C. to $+4\times10^{-3}$ Ω/°C.

Even if the content of MgO as the basic component is increased, the resistivity is kept to about 43 to about 500 Ω.cm, and undergoes no great change, but by addition of $Al_2O_3$, $Y_2O_3$, $La_2O_3$, $Ga_2O_3$, and $In_2O_3$ as the minor components thereto, the resistivity is considerably changed in a range of 91 to $5\times10^{-7}$ Ω.cm. Furthermore, the non-linear coefficient of voltage can be considerably improved to 1.02 to 1.2 by selecting an optimum amount of the minor components $Al_2O_3$, $Y_2O_3$, $La_2O_3$, $Ga_2O_3$, and $In_2O_3$ to be added, but addition of too large an amount of the minor components $Al_2O_3$, $Y_2O_3$, $La_2O_3$, $Ga_2O_3$ and $In_2O_3$ lowers the withstanding capacity against the switching surge.

It is seen from the foregoing that a particularly preferable composition for a circuit breaker resistor comprises 95 to 85% by mole of ZnO and 5 to 15% by mole of MgO as basic components and one of 5 to 15% by weight of $Al_2O_3$, 0.5 to 5% by weight of $Y_2O_3$, 0.3 to 1% by weight of $La_2O_3$, 0.5 to 5% by weight of $Ga_2O_3$, and 0.1 to 5% by weight of $In_2O_3$.

Example 6

Figure 7:
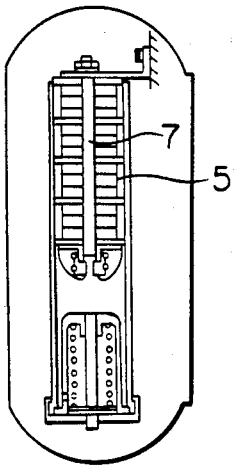
FIG. 7 is an enlarged structural view of a resistor for the resistance made in a gas circuit breaker (GCB) and FIG. 7A is a structural view of the gas circuit breaker.
Figure 7A:
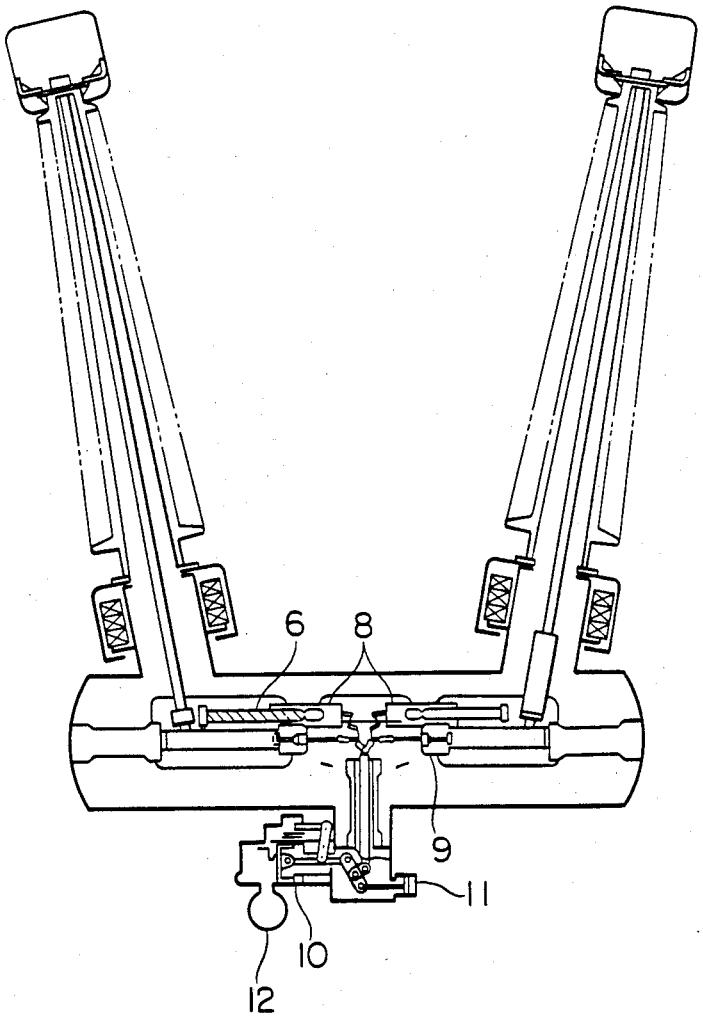
Figure 8:
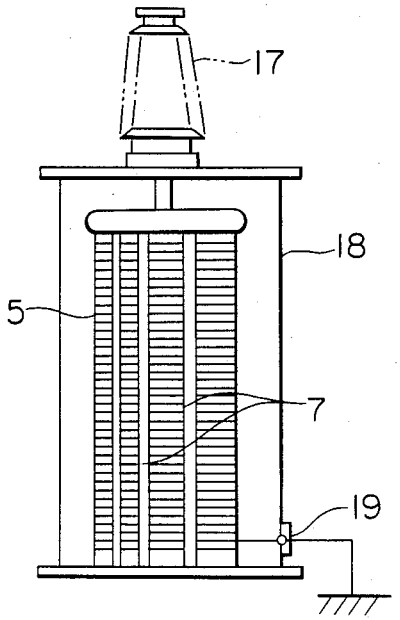
FIG. 8 is a structural view of $SF_6$ gas-insulted neutral grounding (NGR).

In FIGS. 7A and 8, applications of the present oxide resistors prepared in Examples 1 and 4 each to a resistance in a gas circuit breaker (GCB) and an $SF_4$ gas-insulated neutral grounding (NGR), respectively, are shown. The resistor 5 of FIGS. 7A (shown in an enlarged view in FIG. 7) and 8 are in a cylindrical form shown in FIG. 5, where 6 is a bushing, 7 a tank, 8 a condenser, 9 a breaker, 10 an oil dash-pot, 11 a piston for switching operation, and 12 an air tank.

In FIG. 8, 17 is a bushing, 18 a tank and 19 a grounding terminal.

According to the present invention, a resistor can be made smaller in size and lighter in weight by using an oxide resistor having such distinguished characteristics as a very large withstanding capacity against the switching surge, a small non-linear coefficient of voltage in the voltage-current characteristics, a positive, smaller resistance-temperature coefficient, and a small percent change in resistivity after heat treatment at 500° C. in the atmosphere, as described above.

What is claimed is:

1. A composite sintered oxide resistor, obtained by sintering a powdery oxide mixture of zinc oxide as the main component and other oxide of metal or semi-metal other than zinc oxide, free from bismuth oxide, so as to form crystal grains of zinc oxide and crystal grains having an electric resistance of 200 Ω to $3\times10^{13}$ Ω, free from a grain boundary layer having a higher electric resistance than that of the crystal grains of zinc oxide, the resistor being in a plate form and having electrodes at both end surfaces, and having a non-linear coefficient of voltage of 1.0 to 1.3 at $3\times10^{-3}$ to 80 A/cm$^2$.

2. A composite sintered oxide resistor, obtained by sintering a powdery oxide mixture of zinc oxide as a major component and other oxide of metal or semi-metal than zinc oxide, free from bismuth oxide powder, the resistor having a resistance-temperature coefficient of $5\times10^{-4}$ Ω/°C. to $-5\times10^{-4}$ Ω/°C. at 20° 1 to 500° C., a resistivity of 100 to 4,000 Ω at 20° C., a withstanding capacity against switching surge of 500 to 800 J/cc, and a non-linear coefficient of voltage of 1.0 to 1.3 at $3\times10^{-3}$ to 80 A/cm$^2$.

3. A composite sintered oxide resistor, which is obtained by sintering a powdery oxide mixture containing 0.1 to 10% by mole of magnesium oxide, 0.1 to 20% by mole of at least one of yttrium oxide, aluminum oxide, gallium oxide, lanthanum oxide and indium oxide, and the balance being zinc oxide, free of bismuth oxide, having zinc oxide grains and a grain boundary layer having a lower electric resistance than that of said zinc oxide grains being formed between crystal grains, and the resistor having a non-linear coefficient of voltage of 1.0 to 1.3 at $3\times10^{-3}$ to 80 A/cm$^2$.

4. A composite sintered oxide resistor according to claim 3, wherein the powdery oxide mixture comprises 70 to 92% by mole of zinc oxide, 3 to 10% by mole of magnesium oxide, and 5 to 15% by mole of aluminum oxide.

5. A composite sintered oxde resistor, which is obtained by sintering a powdery oxide mixture containing 68 to 90% by mole of zinc oxide, 3 to 10% by mole of magnesium oxide, 5 to 15% by mole of aluminum oxide and 1 to 2% by mole of silicon oxide, free from bismuth oxide, having crystal grains of zinc oxide and a grain boundary layer having a lower electric resistance than that of said crystal grains of zinc oxide being formed between the crystal grains, and the resistor having a non-linear coefficient of voltage of 1.0 to 1.3 at $3\times10^{-3}$ to 80 A/cm$^2$.

6. A gas circuit breaker with an oxide resistor, which comprises an oxide resistor being a composite sintered oxide resistor according to any one of claims 1 to 5 and having a column or cylindrical form and electrodes on both end surfaces excluding the side surface.

7. A gas circuit breaker according to claim 6, wherein an insulating glass is provided by baking on the entire side surface of the resistor.

8. An $SF_6$ gas-insulated neutral grounding with an oxide resistor, which comprises an oxide resistor being a composite sintered oxide resistor according to any one of claims 1 to 5 and having a column or cylindrical form and electrodes on both end surfaces excluding the side surface.

9. An $SF_6$ gas-insulated neutral grounding according to claim 8, wherein the electrodes are formed at inner positions than the peripheral side surface.

10. A composite sintered oxide resistor which comprises individual crystal grains including zinc oxide grains, obtained by sintering a powdery oxide mixture of zinc oxide as the main component and other oxide of metal or semi-metal than zinc oxide, free from bismuth oxide, and a grain boundary layer having an electric resistance equal to or lower than that of said zinc oxide grains being present between said individual crystal grains, the resistor having a non-linear coefficient of voltage of 1.0 to 1.3 at $3\times10^{-3}$ to 80 A/cm$^2$.

11. A composite sintered oxide resistor according to claim 10, wherein the grain boundary layer between the individual crystal grains has an electric resistance equal to that of the crystal grains of zinc oxide.

12. A composite sintered oxide resistor according to claim 10, wherein a void exists at the position corresponding to the grain boundary layer between the individual crystal grains.

13. A composite sintered oxide resistor according to claim 10, wherein the metal or the semi-metal element is titanium, silicon, antimony, zirconium, or tin.

14. A composite sintered oxide resistor according to claim 10, wherein the individual crystal grains further comprise grains having the following chemical formula: $Zn_2TiO_4$, $Zn_2SiO_4$, $Zn_7Sb_2O_{12}$, $Zn_2ZrO_4$ or $Zn_2SnO_4$.

15. A composite sintered oxide resistor according to claim 10, wherein the resistor comprises crystal grains of zinc oxide and crystal grains of a zinc oxide compound of other metal or semi-metal element than zinc.

16. A composite sintered oxide resistor according to claim 15, wherein said powdery oxide mixture contains zinc oxide as the main component and at least one oxide selected from the group consisting of titanium oxide, silicon oxide, antimony oxide, zirconium oxide and tin oxide.

17. A composite sintered oxide resistor according to claim 15, wherein said powdery oxide mixture contains zinc oxide as the main component, titanium oxide and magnesium oxide.

18. A composite sintered oxide resistor according to claim 17, wherein said powdery oxide mixture further contains at least one element selected from the group consisting of antimony oxide, silicon oxide, zirconium oxide and tin oxide.

19. A composite sintered oxide resistor according to claim 17, wherein said powdery oxide mixture contains zinc oxide as the main component, magnesium oxide and at least one oxide selected from the group consisting of aluminum oxide, gallium oxide, lanthanum oxide, indium oxide and yttrium oxide.

20. A composite sintered oxide resistor according to claim 19, wherein said powdery oxide mixture further contains silicon oxide.

21. A composite sintered oxide resistor which is obtained by sintering a powdery oxide mixture consisting essentially of 0.1 to 10% by mole of magnesium oxide and 0.1 to 20% by mole of at least one yttrium oxide, gallium oxide, lanthanum oxide and indium oxide, the balance being zinc oxide, having crystal grains of zinc oxide and a grain boundary layer having a lower electric resistance than that of said crystal grains of zinc oxide being formed between crystal grains, and the resistor having a non-linear coefficient of voltage of 1.0 to 1.3 at $3\times10^{-3}$ to 80 A/cm$^2$.

22. A composite sintered oxide resistor which is obtained by sintering a powdery oxide mixture consisting essentially of 68 to 90% by mole of zinc oxide, 3 to 10% by mole of magnesium oxide powder, 5 to 15% by mole of aluminum oxide and 1 to 2% by mole of silicon oxide, having crystal grains of zinc oxide and a grain boundary layer having a lower electric resistance than that of said crystal grains of zinc oxide being formed between crystal grains, and the resistor having a non-linear coefficient of voltage of 1.0 to 1.3 at $3\times10^{-3}$ to 80 A/cm$^2$.

23. A composite sintered oxide resistor which is obtained by sintering a powdery oxide mixture consisting essentially of 70 to 92% by mole of zinc oxide, 3 to 10% by mole of magnesium oxide and 5 to 15% by mole of aluminum oxide, having crystal grains of zinc oxide and a grain boundary layer having a lower electric resistance than that of said crystal grains of zinc oxide being formed between crystal grains, and the resistor having a non-linear coefficient of voltage of 1.0 to 1.3 at $3\times10^{-3}$ to 80 A/cm$^2$.

24. A composite sintered oxide resistor which is obtained by sintering a powdery oxide mixture containing zinc oxide, magnesium oxide, aluminum oxide, and silicon oxide, free of bismuth oxide, and having crystal grains of zinc oxide and a grain boundary layer having a lower electric resistance than that of said crystal grains of zinc oxide being formed between crystal grains.

25. A composite sintered oxide resistor which is obtained by sintering a powdery oxide mixture consisting essentially of 65 to 94.8% by mole of zinc oxide, 0.2 to 154% by mole of magnesium oxide powder and 5 to 20% by mole of titanium oxide, having crystal grains of zinc oxide and a grain boundary layer having an electric resistance equal to or lower than that of said crystal grains of zinc oxide being formed between crystal grains, and the resistor having a non-linear coefficient of voltage of 1.0 to 1.3 at $3\times10^{-3}$ to 80 A/cm$^2$.

26. A composite sintered oxide resistor which is obtained by sintering a powdery oxide mixture containing 5 to 20% by mole of titanium oxide, 0.2 to 15% by mole of magnesium oxide, and 0.2 to 15% by weight of at least one oxide selected from the group consisting of antimony oxide, silicon oxide, zirconium oxide and tin oxide, the balance being zinc oxide, free from bismuth oxide, having crystal grains of zinc oxide and a grain boundary layer having an electric resistance equal to or lower than that of said crystal grains of zinc oxide being formed between crystal grains, and the resistor having a non-linear coefficient of voltage of 1.0 to 1.3 at $3\times10^{-3}$ to 80 A/cm$^2$.

27. A composite sintered oxide resistor according to claim 26, wherein said powdery oxide mixture consists essentially of 65 to 94.8% by mole of zinc oxide, 5 to 20% by mole of titanium oxide, 0.2 to 15% by mole of magnesium oxide, 0.05 to 5% by mole of antimony oxide, 0.2 to 23% by mole of silicon oxide, 0.1 to 7% by mole of zirconium oxide, and 0.1 to 6% by mole of tin oxide.

28. A gas circuit breaker with an oxide resistor which comprises an oxide resistor being a composite sintered oxide resistor according to claim 10 and having a column or cylindrical form and electrodes on both end surfaces excluding the side surface.

29. A gas circuit breaker according to claim 28, wherein an insulating glass is provided by baking on the entire side surface of the resistor.

30. An $SF_6$ gas-insulated neutral grounding with an oxide resistor, which comprises an oxide resistor being a composite sintered oxide resistor according to claim 10 and having a column or cylindrical form and electrodes on both end surfaces excluding the side surface.

31. An $SF_6$ gas-insulated neutral grounding according to claim 30, wherein the electrodes are formed at inner positions other than the peripheral side surface.

32. A composite sintered oxide resistor according to claim 10, wherein said powdery oxide mixture further contains magnesium oxide.

* * * * *